US007478608B2

(12) United States Patent
Wesley

(10) Patent No.: US 7,478,608 B2
(45) Date of Patent: Jan. 20, 2009

(54) AUXILIARY VESSEL LIFTING, LAUNCHING, AND CARRYING SYSTEM

(76) Inventor: William P. Wesley, 473 Waters Dr., Fort Pierce, FL (US) 34946

( * ) Notice: Subject to any disclaimer, the term of this patent is extended or adjusted under 35 U.S.C. 154(b) by 590 days.

(21) Appl. No.: 11/381,208

(22) Filed: May 2, 2006

(65) Prior Publication Data

US 2006/0185575 A1 Aug. 24, 2006

Related U.S. Application Data

(63) Continuation-in-part of application No. 10/964,193, filed on Oct. 14, 2004, now abandoned.

(51) Int. Cl.
*B63B 23/18* (2006.01)

(52) U.S. Cl. ..... 114/373; 114/366

(58) Field of Classification Search ..... 114/259, 114/365, 366, 375, 368–373
See application file for complete search history.

(56) References Cited

U.S. PATENT DOCUMENTS 2,091,327 A * 8/1937 McPartland ..... 114/366

OTHER PUBLICATIONS

Engineering Mechanics Statics, R.C.Hibbeler, third edition, 1983.*

* cited by examiner

*Primary Examiner*—Ed Swinehart
(74) *Attorney, Agent, or Firm*—Joel I. Rosenblatt

(57) ABSTRACT

A system for launching or retrieving an auxiliary vessel, using at least one support frame, with a connected auxiliary vessel support platform, mounted for rotational and translational movement in Cartesian coordinate directions. The support platform may be inclined to proximate the water level to facilitate launch and retrieval operations.

19 Claims, 4 Drawing Sheets

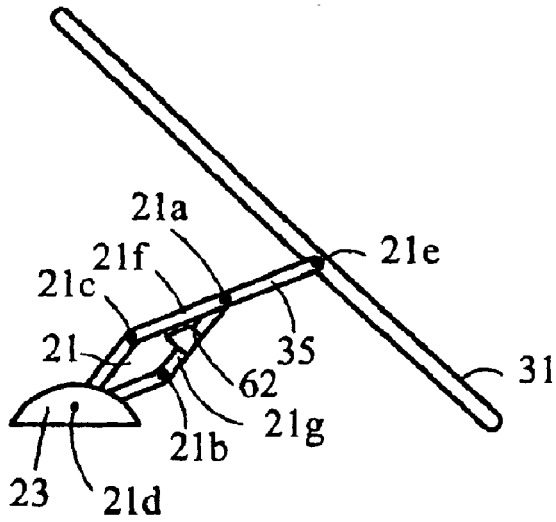
FIG. 3A
FIG. 4
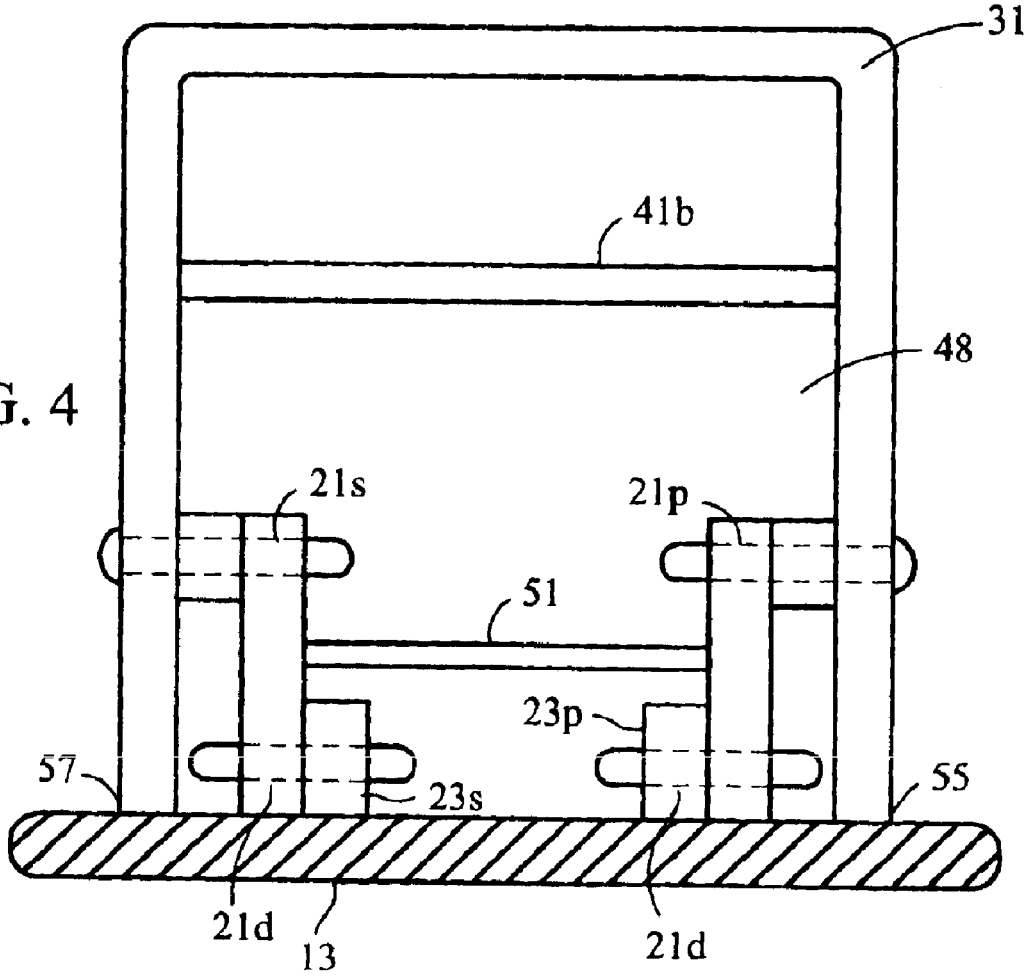

AUXILIARY VESSEL LIFTING, LAUNCHING, AND CARRYING SYSTEM

CROSS REFERENCE TO RELATED APPLICATIONS

This application is a continuation in part of application Ser. No. 10/964,193 filed Oct. 14, 2004

FIELD OF THE INVENTION

The related field is methods and systems for retrieving and lifting an auxiliary vessel from the water, into storage and carrying position and for launching the vessel.

BACKGROUND OF THE INVENTION

The world of watercraft may be separated into two general categories of ships and boats, boats being the smaller vessels, usually pleasure or recreational craft, or yachts. Boats may range in size from an auxiliary vessel, a dinghy for example, carried on with a larger boat, and used to ferry passengers from an anchorage to shore and back, The size of the auxiliary and of the main vessel, carrying the auxiliary dinghy may vary, depending on the application and need.

As ships and boats may travel to destinations lacking embarking or disembarking facilities, for example, docks, wharfs, or slips, the auxiliary vessel is carried on the main vessel and launched when needed. When use is completed, the auxiliary vessel may be retrieved and stored in a suitable arrangement for travel with the main vessel.

Auxiliary vessels, even though small, may present a challenge in launching and retrieving, considering the weight, shape, and distribution of its mass. For example, one popular type of auxiliary vessel is the inflatable generally U_shaped pontoon boat, which opens rearward and has a transom extending between the legs of the pontoons adjacent the rear ends thereof. This transom is conventionally utilized for mounting a small outboard motor. Another type of auxiliary vessel is the personal watercraft.

Hauling an auxiliary vessel that is wide, bulky or heavy, for example, loaded or imbalanced with an attached outboard motor, on to the main vessel, for example one with a high freeboard relative to the length of the auxiliary vessel makes impractical, sliding or pushing or dragging the auxiliary vessel on board. Usually required to lift and place the auxiliary vessel on board, is a lifting device with davits, or a cradle for holding the auxiliary vessel and lifting it from the water, and holding it in its lifted position, for swinging it out board of the main vessel, or swinging it on to the main vessel to a storage position.

Many devices, for example the devices shown in issued U.S. Pat. Nos. 5,113,783, 5,018,473, and 4,864,951, disclose devices for holding, or lifting, an auxiliary vessel from its floating position, but none are able to accomplish the method of sliding or pushing or pulling, an auxiliary vessel onto or off, a storage platform and moving the storage platform from its retrieving position into its storage position in the process or retrieving the auxiliary vessel or moving the vessel from its storage position into its launch position, in the process of moving the auxiliary vessel off the storage platform and toward the water.

Other devices, for example as shown in U.S. Pat. Nos. 6,474,256 and 6,786,170, disclose auxiliary lifting and carrying devices which are hung outboard of the main vessel and merely lift or place an auxiliary vessel from or in the water, but do not carry the auxiliary vessel inboard of the main vessel or use an over the center device to use the torque produced by the weight of the auxiliary vessel as an assist or to hold the support platform used to support the auxiliary vessel in the carry or launch positions.

SUMMARY OF THE INVENTION

Accordingly, it is an object of this invention to provide a method and system for easily retrieving an auxiliary vessel from its floating position, outboard of the main or carrying vessel arranged in a conventional fore and aft direction with its transom at its aft end and with a conventional port and starboard.

For purpose of explanation, transom as used in describing the invention means the surface, forming the stern end of a boat. It may apply to but is not necessarily restricted to, a flat surface.

It is an object to launch an auxiliary vessel from an inboard carrying position and forward of the transom by displacing the auxiliary vessel over the transom and over the water dispose opposite the transom outboard of the main vessel and opposed to the transom of the main vessel.

It is an object of this invention to retrieve or launch an auxiliary vessel by sliding the auxiliary vessel on board onto a support platform or into the water, without the use of lifting davits or other arrangements for elevating the auxiliary vessel from its floating position and transporting it over the stern end or transom, of the main vessel and at least partially within the area enclosed by the main vessel hull.

It is another object of this invention to provide a method and system for carrying an auxiliary vessel in board of a main vessel within an area enclosed by the hull and with the auxiliary vessel's fore aft line aligned with the fore aft line of the main vessel.

It is another object of this invention to displace an auxiliary vessel from its storage position to a launch position, aft of the transom or stern of the main vessel.

It is another object of this invention to launch and retrieve an auxiliary vessel to or from a position outboard the main vessel, and from a position astern or aft of the main vessel relative to the main vessel fore aft line and from the water at the main vessel stern or transom.

It is another object of this invention to provide a method and system for transferring an auxiliary vessel from its floating position, disposed opposite the transom of the main vessel and arranged with the auxiliary vessel for aft line substantially aligned with the fore aft line of the main vessel, on to a storage or support platform, positioned in an inclined position over the stern or transom of the main vessel and with one end toward the open water, aft of the transom, for easy movement of the auxiliary vessel onto the lower edge of the storage platform, and by sliding the auxiliary vessel onto the platform, toward its upper end, for retrieval or by sliding the auxiliary vessel toward the support platform lower end and into the water for launching.

It is another object of this invention to mount the support platform on a support frame, which is mounted for rotation to the main vessel about an axis of rotation and wherein the torque produced by the force of the weight of the support platform is about the axis of rotation.

It is another object of this invention to mount the support frame for rotation through a path, to and from the storage carry position and the launch support position, through an over the center position where the force of the weight from the support platform is through the axis of rotation and there is no torque produced about the axis of rotation.

It is another object of the invention, to move the auxiliary vessel support platform into a storage carry position which may be a horizontal storage position and to latch it in place. The latch may be a mechanical latch or the support platform may be held in place by the force applied by the weight of the support platform producing a torque about the axis of rotation and which is in the direction of the storage position.

It is another object of this invention to drive the support platform by the torque produced by the weight of the storage platform about the axis of rotation, in response to the support frame rotating past the over the center position or through the over the center position, and being located on the side of the launch retrieve position, relative to the over the center position.

It is another object of the invention, to move the auxiliary vessel support platform into a storage carry position which may be a horizontal storage position and to latch it in place. The latch may be a mechanical latch or the support platform may be held in place by the force applied by the weight of the support platform producing a torque, which is in the direction of the storage position.

It is another object of the invention, to move the platform into a storage position by a complex rotational movement of a pivoted jointed polygon, for example a parallelogram with its legs connected by rotational connectors with respective axes of rotation for pivoting movement about its connections or joints and for translational movement of the polygon.

It is another object of this invention to provide a full or partial docking or locking system for holding the support platform in position when in its storage position and restraining it securely for transit and for limiting the travel of the support platform when it reaches its storage or launch positions.

These and other objects of the invention will be apparent to those skilled in the art from the description of the invention in this Summary and in the Detailed Description.

It is another object of this invention to mount the support platform used for carrying the auxiliary vessel, for rotation about a connection to the support frame.

It is another object of this invention to rotate the support frame about its rotating connection to the support frame to place the support frame in an inclined position with the end of the support frame disposed aft, in relation to the fore aft line and fore and aft, of the main vessel, over the water outboard of the hull of the main vessel with the lower end of the support frame disposed over the water for launch or retrieval of an auxiliary vessel.

The invention, as shown in a preferred embodiment, uses the principles of an expanding/collapsing support, for example a scissors jack in the form of a polygon with rotating joints connecting its support legs, and for the example shown in a preferred embodiment, four supports, forming a four sided parallelogram polygon, with each support leg joined at the four respective ends for pivoting movement. The support frame, in a preferred embodiment, uses two parallel support frames or support frames connected by transverse supports to form a box for stability, with the two parallel support frames forming the sides of the expanding/collapsing support scissors jack.

As shown in a preferred embodiment, the support frame or support frame is connected to a base platform, by a base pivoting connection or joint mounted on a base platform. As shown in a preferred embodiment the base platform is mounted on a main or carrying vessel and proximate the water line to facilitate retrieving and launching an auxiliary vessel. As shown in a preferred embodiment, the supporting base is a platform attached to the transom of the carrying boat or vessel and with an end opposed to the open water. As would be apparent to those skilled in the art, the supporting base or the method or structure used to attach the support frame to the base platform, may be varied without departing from the disclosed inventive principles.

Mounted for pivoting movement on the support frames, at, or proximate, a support leg pivoting joint connecting adjacent support legs, shown for a preferred embodiment at the pivoting joint connection of two of the parallelogram legs, which is opposed to the base joint, is a support launch/carrying platform.

The platform may be mounted at an opposed pivoting joint or on an extension of one of the support frame supports or legs connected by the pivoting joint and extending outside the support frame or may be mounted on the support frame, between the pivoting joints, or by an extension of a support leg inside the support frame. The support platform may be mounted on one of the rotating connections adjacent the rotating base connection of the support frame to the support base.

According to the disclosed inventive principles as shown for a preferred embodiment, the support platform supported by the expanding/collapsing support frame is rotated and translated by a physical displacement between a launch retrieve position and to a storage carrying position. In the launch retrieve position, the support launch/carrying platform is inclined with a first edge positioned proximate the water line and proximate the edge of the base support opposed to the open water, to facilitate launching and retrieval.

In the storage carrying position, the support launch/carrying platform is rotated and translated from its inclined launch and retrieve position, to a carrying position, shown in a preferred embodiment as substantially horizontal.

According to the disclosed inventive principles, as shown for a preferred embodiment, a support frame rotates about its respective base joint, while the respective support frame or support frame supports or legs, pivotally linked to each other, rotate about the pivot joints at their respective support leg ends to translate the support frame axes, passing through respective opposed corners of the support frame, from a non rectangular parallelogram as shown in a preferred embodiment, through a square or rectangular position, depending on the relative lengths of the support frame legs and through a central position. In a preferred embodiment, where the support frame is a parallelogram comprised of equal lengths for the opposed support legs, the legs are connected to each other for rotation about the axes or the respective support leg connections. In the process of rotating the support frame about the rotating base connection, each of the support frame support legs rotates about its respective rotating connection to an adjacent leg and the support frame parallelogram passes from a shape with two opposed acute angles and two obtuse angles, as would be understood by those skilled in the art, through a shape with opposed right angles. Continued rotation of the support frame, for example through the over the center position would drive the support frame back to a parallelogram with opposed acute angles and opposed obtuse angles.

In a preferred embodiment, the support frame may be used in its storage carry position or its launch support position, on one side of the over the center vertical position.

The result of this complex movement, as shown and disclosed according to a preferred embodiment, is to move the support launch carrying platform from its carrying position on the main or carrying vessel to its launch position where the support launch carrying platform is translated proximate the open water with an inclined end, proximate and opposed to the open water and the open water end of the base platform, and then back to its storage carrying position.

In the disclosed preferred embodiment, the base platform for the support is a platform extending from the transom of the main or carrying vessel and arranged with an end opposed to the open water. However, as would be understood by those skilled in the art, the invention as shown according to its disclosed inventive principles, may be place on the port or starboard of a main or carrying vessel or in a forward position, without departing from the disclosed inventive principles.

In operation, when the auxiliary vessel is launched, the support platform, is displaced toward its launch position, shifting the weight of the support platform and displacing its weight over the support frame central position, which may be the center vertical, where the rotational direction of the torque developed by the weight of the support platform is redirected in an opposite direction, from a direction toward the storage carrying position to the launch retrieval position.

The reverse occurs when translating the support platform from its launch retrieval position to its storage carrying position. Retrieving the auxiliary vessel is the reverse process with the support frames being translated through over the support frame central position, which may be the center vertical position and with the weight of the support platform producing a torque rotating the support platform to its storage carrying position, upon passing through the support frame central or vertical center position.

What is disclosed and claim herein is as follows.

A system for launching and retrieving an auxiliary vessel in the fore aft direction of a main vessel comprising, a main vessel, including a main vessel hull arranged in a fore aft direction; the main vessel hull including a transom on the aft part of the main vessel; a base attached to the main vessel proximate the transom; a support frame; the support frame including a first pivoting connection to the base; a support platform; the support frame including a second pivoting connection to the support platform; the support frame connected to the base by the first pivoting connection for displacement of the support platform in a displacement path in the main vessel fore aft direction, and from a first position for launch or retrieval, displaced outboard from the main vessel hull and outboard of the transom, to a second position for storage or carry of an auxiliary vessel, inboard of the main vessel hull and inboard of the transom.

Additionally shown and claimed is the support platform includes a first end and a second end; the first end is disposed aft from the second end in the main vessel fore aft direction; the support platform connected to the support frame, by the second pivoting connection for rotation between an inclined position with the first end lower than the second end, for launch or retrieval of an auxiliary vessel to a horizontal position, for storage or carry of an auxiliary vessel.

Additionally shown and claimed is the fore aft path includes a center vertical position between the first position and the second position, where the direction of a force from the weight of the support platform is through the first pivoting connection.

Additionally shown and claimed is the first pivoting connection includes a first axis of rotation; the fore aft path includes a position disposed between the center vertical position and first position where the force from the weight of the support platform produces a torque about the first axis of rotation causing a rotation of the support frame toward the first position.

Additionally shown and claimed is the path includes a position disposed between the center vertical position and second position where the force from the weight of the support platform produces a torque about the first axis or rotation causing a rotation of the support frame toward the second position.

Additionally shown and claimed is the displacement path is from inboard the main vessel hull, over the transom, and outboard the main vessel hull.

Additionally shown and claimed is the support frame includes at least a first and second sets of at least four legs, arranged in respective first and second parallelograms; the respective first and second parallelograms each including the first pivoting connections and the respective first and second parallelograms are each connected to the base by the first pivoting connections; and the respective first and second parallelograms are connected to form a parallelepiped for rotation about the first pivoting connections.

Additionally shown and claimed is the respective first and second parallelograms each include the second pivoting connection and each include a major axis with a length extending from the first pivoting connection to the second pivoting connections of the respective parallelograms; The respective first and second parallelograms are mounted on the base wherein the major axis length contracts as the support frame is rotated in the fore aft path toward the center vertical position and expands as the support frame is rotated away from the center vertical position.

Additionally shown and claimed is a stop mounted for engagement with the support frame to stop movement of the support frame in the path, past the first position or the second position.

Additionally shown and claimed is a docking fixture including a first interlocking part on the main vessel and a second interlocking part on the support platform; the docking fixture placed in the path proximate the second position to engage the second interlocking part when the support platform is in the second position.

BRIEF DESCRIPTION OF THE DRAWINGS

FIG. 3*a*, shows a variation of the support frame of FIG. 3, with an extension to one of the support frame support legs mounting the support platform on a pivoting support and outside the support frame, and with a stop for stopping the rotational movement of the support frame at its intended launch retrieve position.

FIG. 4 shows in a front view from the forward part of the main vessel, looking aft toward the open end of the base platform to the transom and toward the open water, two scissors jack support frames, as shown in FIG. 1, arranged in a set of parallelogram support frames, in the process of translational movement as shown in FIG. 2, and with the expanding/collapsing parallelogram support frame scissors jack box frames connected with a cross member connecting port and starboard support frames, with the support platform mounted on the outside or exterior to the support box frame, and shown with the storage carry platform in the launch retrieve position.

DETAILED DESCRIPTION OF THE INVENTION

A preferred embodiment of the invention is shown in connection with a main or carrying vessel arranged in a convention manner in a fore aft alignment or fore aft direction with the transom at the back or aft or stem end and with conventional port and starboard sides, and with reference to the forward or bow or front end. The invention for launching and retrieving an auxiliary vessel is shown mounted in the fore and aft direction proximate the stern of the carrying or main vessel and with two parallel support frames connected to form a parallelepiped or box with the support frames placed on the port and starboard sides, relative to the main vessel's fore and aft line. The same numerals are used in the Figures to show the same or similarly operating parts and particularly for the port and starboard support frames. "Pivoted," as used means arranged for pivoting or rotational movement about an axis. The terms support frame or support frame or scissors jack, as used herein, refer to the support frame 21, shown in the preferred embodiment in the form of a two interconnected parallelogram scissors jacks. As shown for a preferred embodiment, the parallelogram scissors jack frames are each connected to an adjoining leg at the respective ends, by a pivoting connection for rotation about an axis of rotation through the pivoting connection. The support frames are arranged on the port and starboard sided of the main vessel to form a parallelepiped, as shown by the front view or bow to stem view, in FIG. 4.

Figure 1:
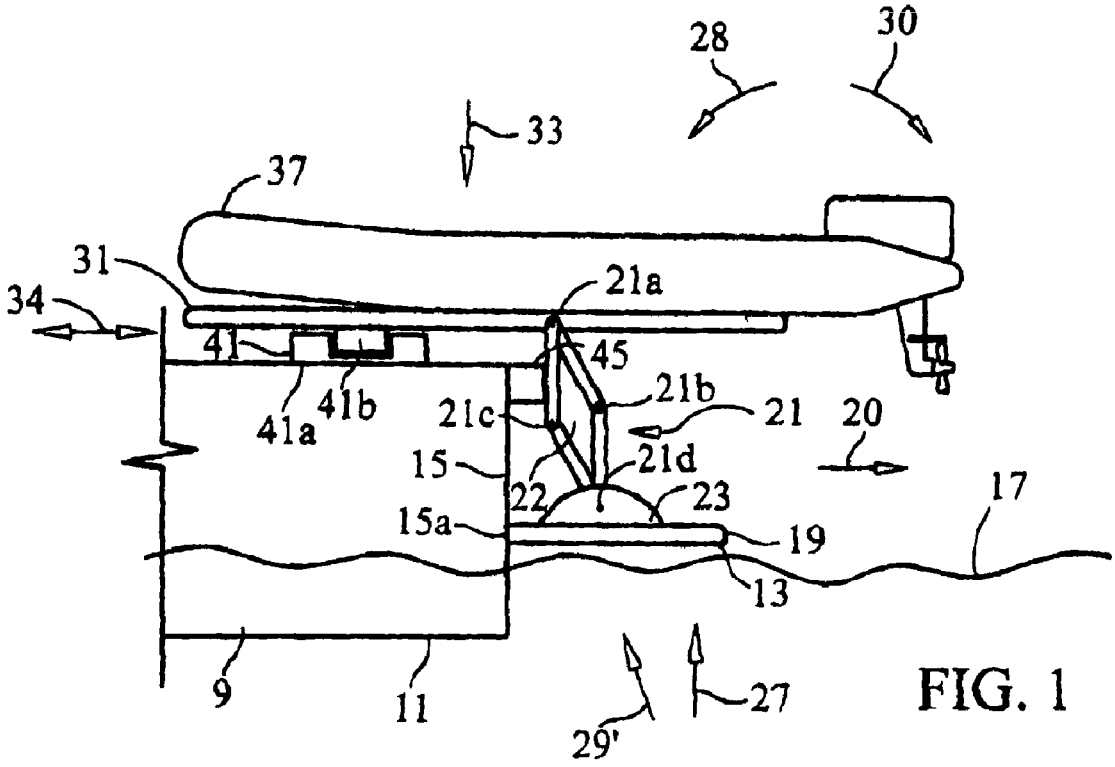
FIG. 1 shows the expanding/collapsing support frame arranged in a scissors jack configuration as a parallelogram of four pivotally interconnected legs and in a view toward the port side of the main vessel and showing the port side support frame and the support platform in its storage carrying position.

The invention is shown in FIG. 1, and in a preferred embodiment, generally by numeral 11, in its storage carry position, viewed from the port side of the main or carrying vessel 9. The vessel 9 as shown, has an inboard area within or enclosed by the hull and as would be conventionally known to those skilled in the art, as the area within the hull area of the main vessel 9, for example in the cockpit part of the main vessel, as would be understood by those skilled in the art. The invention, according to its disclosed inventive principles is shown mounted on a base platform 13 attached to the transom 15 at the aft end or stem of a main or carrying vessel 9, at location 15*a*, and proximate the water line 17. The base 13 or base platform 13, is shown for a preferred embodiment, as having an open end 19, opposed to and over the open water, as indicated by arrow 20 and arrow 17, and outboard of the main vessel 9.

The disclosed invention as viewed from the port side of main vessel 9, comprises a parallelepiped box frame, comprised of two scissors jack frames 21*p* and 21*s*, each arranged in a parallelogram comprised of four pivotally linked and connected legs, each arranged in a parallelogram, and on the port and starboard, and which is shown as 21*p* and 21*s* in for the forward to aft view of the arrangement of the invention, as shown in FIG. 4. The port and starboard jack frames 21*p* and 21*s*, are expanding/collapsing support scissors jack frames 21, the port side jack frame shown in FIG. 1, for a preferred embodiment, with four legs connected as shown by pivoting or rotating connectors 21*a*, 21*b*, 21*c*, and 21*d*. Rotating pivot joint 21*d* is connected by a pivoting connection with an axis of rotation, as would be understood by those skilled in the art, to the jack frame base 23 which is mounted on the base platform or base 13. Any suitable arrangement may be used pivotally mount the expanding/collapsing support scissors jack frame 21 onto a suitable base 13 by a pivoting connection as would be known to those skilled in the art and these arrangements do not form part of the disclosed invention or would alter the disclosed inventive principles.

As would be understood by those skilled in the art, the disclosure with regard to the port jack frame 21*p* applies to the starboard jack frame 21*s*, as shown in a preferred embodiment in FIG. 4.

Figure 1A:
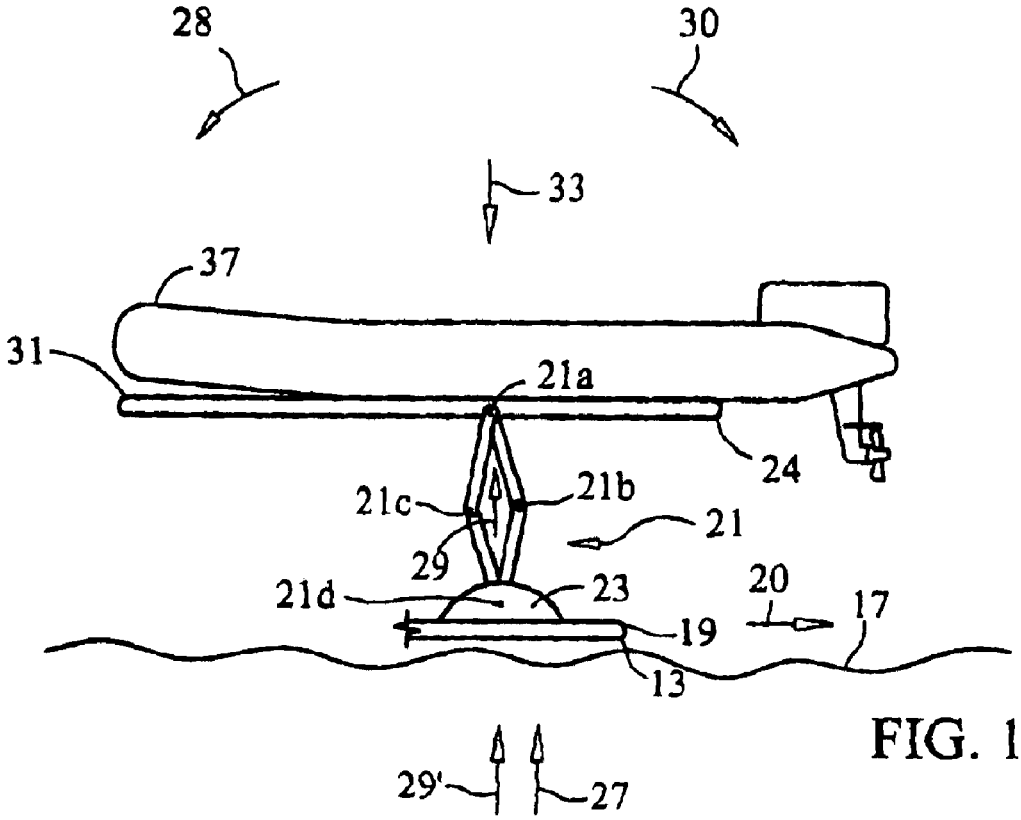
FIG. 1*a*, is a partial view of FIG. 1 showing the port side support frame in a central or center vertical position where the rotational direction of the torque on the support frame under the weight of the support platform, can change from a direction toward the storage carrying position to the launch retrieval position, and in reverse, by moving the support frame in a path from or to the storage and launch positions, and over or through the center vertical position.

Attached to the support frame 21 at pivot joint 21*a* is support platform 31. As shown in FIG. 1 an auxiliary vessel 37 is shown supported by the support platform 31 in its storage carrying position. As shown for a preferred embodiment, the auxiliary vessel 37 is in a horizontal position relative to the water line 17, and as would be understood by those skilled in the art. As shown in FIG. 1A, The support frame 21 axis 29, has a length and direction extending from the two opposed pivot connections 21*a* and 21*d* through the center 22 of the parallelogram support frame 21. As shown in FIG. 1, for, explanation purposes, the support frame axis 29 is shown by axis 29' displaced from the support frame 21, the support frame axis 29. In FIG. 1, the support frame 21 is shown rotated in the path between the storage position and the launch position and through the over the center position, as shown by the inclination of arrow 29' from the vertical as shown by arrow 27. In this position, the force of the weight of the storage platform 31 acting on the support frame 21 through the rotating connection 21*a*, drives the support frame 2 in the rotational path shown by arrows 28 and 30 and for the position of the support frame 21 as shown in FIG. 1, toward the support position and in the direction of arrow 28.

Figure 3:
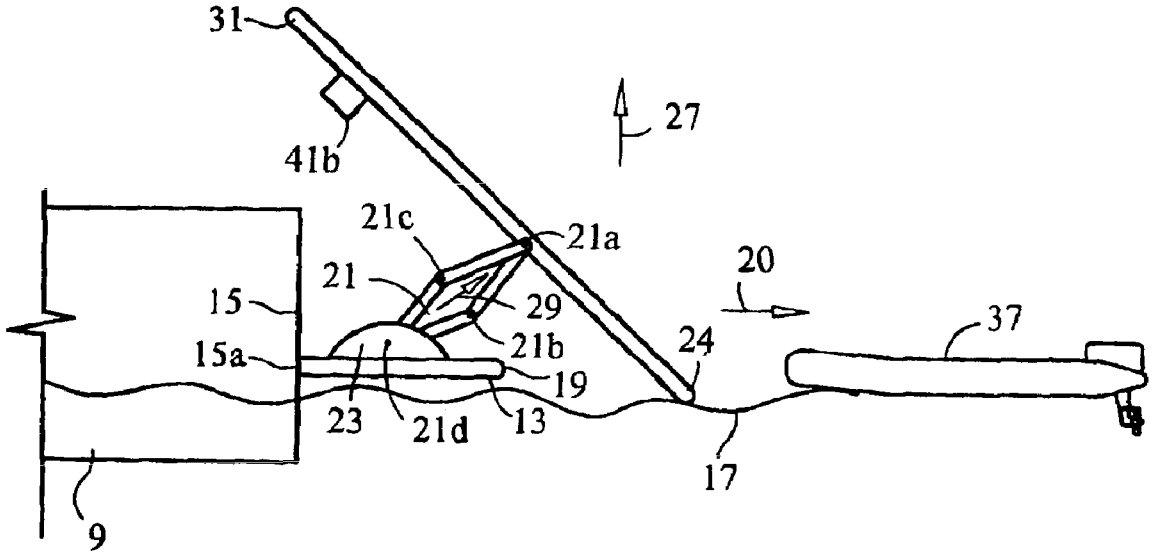
FIG. 3 shows the port side support frame, in a preferred embodiment of the invention, viewed from the port side, with the port support frame of FIG. 1, rotated to its launch retrieve position, and with the support platform inclined with a lower end proximate the open water and extending beyond the open end of the base platform.

As would be understood by those skilled in the art, the support frame 21 when rotated through the center vertical position as shown in FIG. 1A. and toward the launch position as shown in FIG. 3, would produce a torque driving the support frame in the direction of arrow 30 to the launch position.

Figure 2:
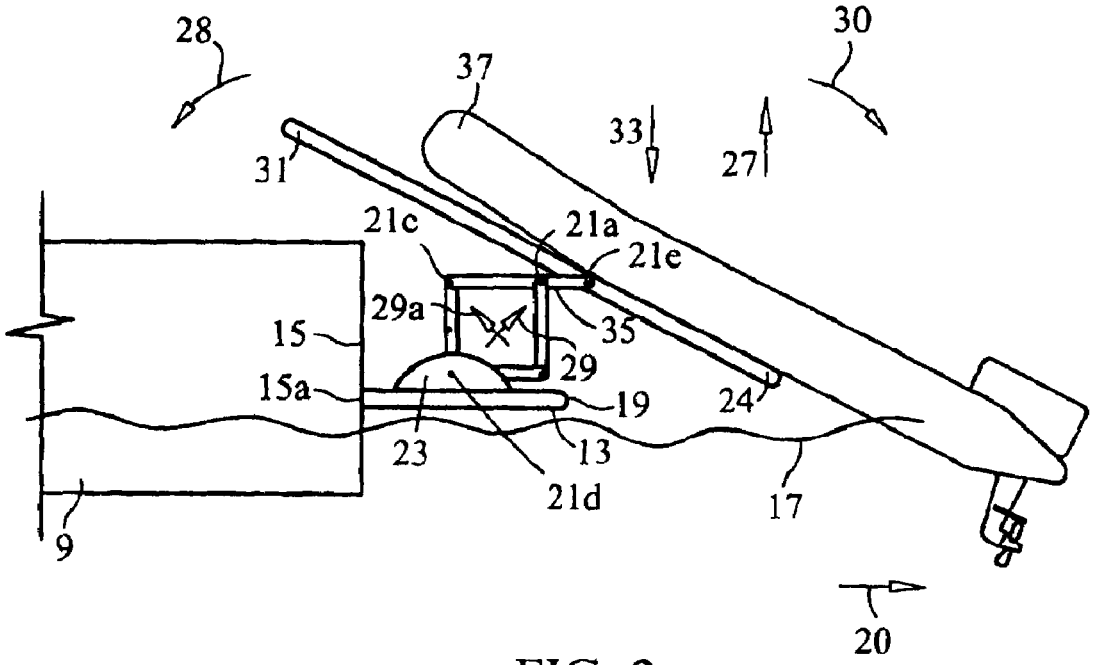
FIG. 2 shows the port side support frame as shown in FIG. 1, rotated from the storage carrying position or to the launch retrieval position, and in translation where the port and starboard support frames 21*p* and 21*s*, as shown in FIG. 4, may pass through a square or rectangle, shape.

As would be understood by one skilled in the art, the weight of the support platform 31 with or without an auxiliary vessel 31 has a force downward, as shown by arrow 33. As would be known to those skilled in the art, the force 33 is directed to the support frame 21 though the pivoting joint or pivoting connection 21*a* linking the support platform 31 with the support frame 21. As shown in FIGS. 1, 1A, 2, 3, 3A. 5, and 6, the support frame 21 is rotated in a path about the axis of the pivoting joint or pivoting connection 21*d* and in a path extending from a first launch retrieve position, as shown in FIGS. 2, 3 and 6, to a second storage carry position shown in FIGS. 1 and 5.

FIG. 1*a* shows the support frame 21 in a support frame central position or center vertical position for a preferred embodiment, over center with regard to the vertical 27 and the axis 29, 29', of the support frame 21.

As would be understood by those skilled in the art, and as shown in FIG. 1*a*, the term "over center," is used for a preferred embodiment to show a point in the rotational travel of the support frame 21, about rotational axis 21*d*, in the directions as shown by arrows 28 or 30, toward the support carry or launch retrieve, position, where the force due to the weight of the platform 31, with or without an auxiliary vessel 37, through the pivoting joint 21*a*, on support frame 21, develops no torque causing rotation on the support frame 21 in the direction of arrow 28, toward the support carry position as shown in FIG. 1 or in the direction of arrow 30, towards its launch retrieve position as shown in FIG. 3. In the over center position, as would be apparent to those skilled in the art, the force due to the weight 33 is through the axis of rotation of the support frame pivoting connection 21*d* to the base 19.

Torque as used in connection with this description of a preferred embodiment, has it usual and customary meaning of the product of a force acting through a moment arm about an axis and the tendency of the force to produce rotation about the axis of pivoting connection 21*d*. It is well known and described in *Sears, Zermansky, Young University Physics, Sixth Edition*, Addison-Wesley Series in Physics, copyright 1982, pages 166-167.

As would be known to those skilled in the art, the central or center vertical position is used to illustrate a position in the travel of the support frame 21 where the torque on the support frame changes direction. As would be known to those skilled in the art, the central or vertical center, position of the support frame 21 where the torque changes direction may be varied by the size and shape of the support frames, the location of the support platform relative to the support frame 21 and the placement of the auxiliary vessel on the support platform 31.

In FIG. 1*a*, the position of pivot joint 21*d* is shown on the base support 23 with respect to the view toward the port side of the main vessel.

As shown for the preferred embodiment in FIG. 1, there is a docking fixture 41 with interlocking parts 41 and 41*b*. As shown in a preferred embodiment, the docking fixture uses a stud 41*b* aligned to fit into receptor 41*a*. Docking fixture 41 is intended to prevent the platform 31 from moving in the direction of bi directional arrow 34, past the intended storage carry position or towards the center and the launch positions, as shown in FIG. 1*a* and FIGS. 3 and 6. Another docking fixture 45 may cooperate with transom 15 of the carrying vessel 9, to prevent the support frame 21 and platform 31 from moving under the weight 33 of the support platform 31 and the auxiliary vessel 37, in the rotational direction as shown by arrow 28, past its intended alignment position in the support carry position as shown by the alignment of the axis 29', of the support frame 21. The locking or docking devices 41 and 45 serve as limits to the travel of the support frame 21 and as restraining or retention devices to hold the support frame 21 and the support platform in position. As would be known to those skilled in the art, other suitable devises as now or hereafter known, may be used to hold the storage platform 31 in its store carry or launch retrieve, positions.

As would be apparent to one skilled in the art, the various means or devices for docking and to hold the platform 31 and support frame 21, aligned with its intended support carry position, may be varied and any suitable means may be used, without departing from the disclosed principles of the invention.

Referring to FIG. 2, the support frame 21 is shown at a point in its physical displacement or translation to or from its support carry or launch retrieve, final position, as represented by directional arrows 28 and 30. As may be seen from FIGS. 1, 1*a*, 2, and 3, the support platform 31 undergoes a translational movement as it is translated by a complex motion combining movement in a Cartesian coordinate direction, shown in a preferred embodiment in a substantially horizontal and vertical direction or, for example, in a direction from the support carry position to the launch retrieve position, and rotational movement about an axis, of the support frame 21, as the support frame 21 contracts in going from one position, and expands along the main axis to the other position, going through a support frame central or center vertical position as shown for a preferred embodiment. In its translational movement, the parallelogram support frame 21, as shown in a preferred embodiment, expands along its cross axis 29*a* and contracts along it main axis 29, as the support frame is translated from its support carry position or launch retrieve positions, to where the support frame 21 may be a square or rectangle, as shown in FIG. 2, and then contracts along its cross axis 29*a*, and expands along its main axis 29, as the support frame 21 rotates to final launch retrieve or support carry positions, respectively. Similarly, the support frame 21 would contract and then expand along its axis 29, as the support frame 21 is displaced or passes through its central or center vertical position.

The translational movement of the support frame 21, comprising support frames 21*p* and 21*s*, rotating on respective axis 21*d*, and arranged a box or parallelepiped displaces the support frame by rotation about axis 21*d* in base 13 and displaces the support frame 21 and the support platform 31 in its Cartesian or linear directions, shown in the preferred embodiment, as approximate the horizontal with reference to the horizontal or water line 17 and the vertical with reference to arrow 27, to extend the support platform 31 to the first position or launch retrieve position or the second position or support carry position.

As would be apparent to one skilled in the art, the complex movement by rotation and in the Cartesian coordinate system, describing the translational movement of the support frame, reduces the displacement of the support platform 31, mounted on the support frame 21, in the vertical direction and horizontal direction, as compared to a displacement limited rotation only about a rotational axis, for example, 21*d* as shown in a preferred embodiment. The complex translational movement in the linear and rotational, directions raises and lowers the support platform 31 while displacing the support frame substantially in the path between the first launch retrieve position and the second storage carry position, passes over the transom 15, and from the second position where the support platform 31 is at least partly inboard the main vessel to the first position where the support platform is at least partly outboard the main vessel. In displacement of the support frame 21 in the path between the first and second positions, the support frame undergoes a translation along Cartesian coordinates, or linear orthogonal directions to extend the support platform 31 to its support carry or launch retrieve, positions while rotating the support platform through its central position.

Referring to FIG. 3 and FIG. 3A, the platform 31 and the support frame 21 are shown for a preferred embodiment, in the launch retrieve position with the auxiliary vessel 37 in the water opposed to the open water end 19 of base 13, and the inclined end 24 of the support platform 31. The rotational movement of support 21 frame and support platform 31, in the path between the first launch support position and the second storage carry position is stopped and the support frame 21 is held in this position and prevented from movement toward the water line 17 by frame stop 62 shown mounted on support leg 21*g* on support frame 21 and in contact with an adjacent leg 21*f*, as shown in FIG. 3A. As would be understood by those skilled in the art, the frame stop 62 is not limited to a stopping member extending from one leg of the support frame 21 to an adjoining member but may be used with any of the frame 21 support legs.

Figure 5:
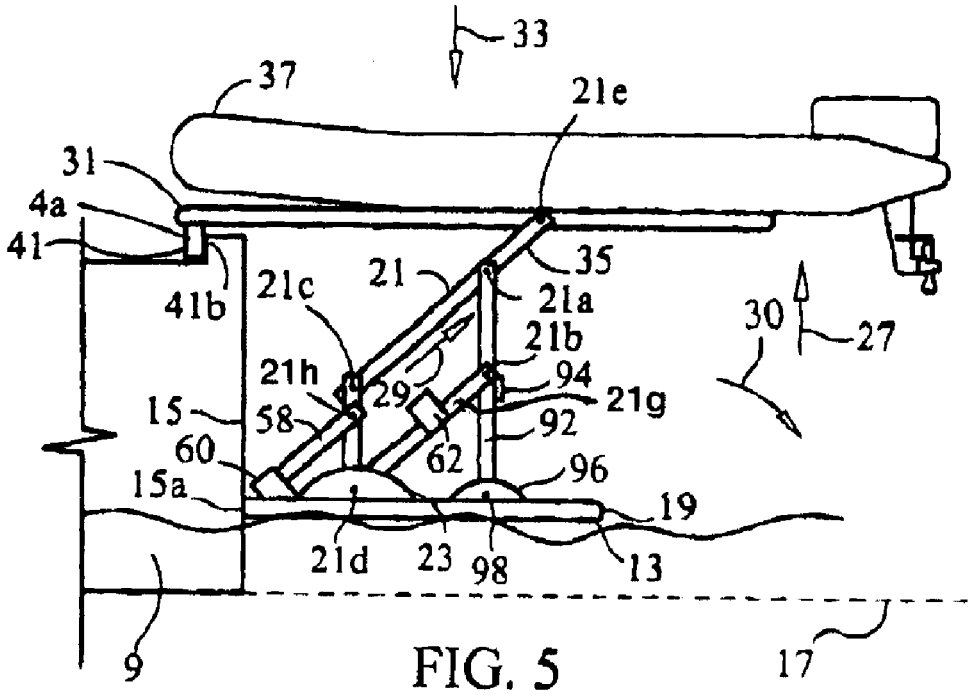
FIG. 5 is FIG. 1 modified to show the port support frame of the support frame scissors jack in a storage position with the support frame axis on the launch retrieve side of the support frame central or center vertical position, as shown and described with reference to FIG. 1, and with limit and restraining stops, to stop the support frame and the support platform from over traveling its storage carrying position and with supports for holding the support platform in it storage position and against the torque produced by the weight of the support platform about the support frame pivot joint toward the launch retrieve position.
Figure 6:
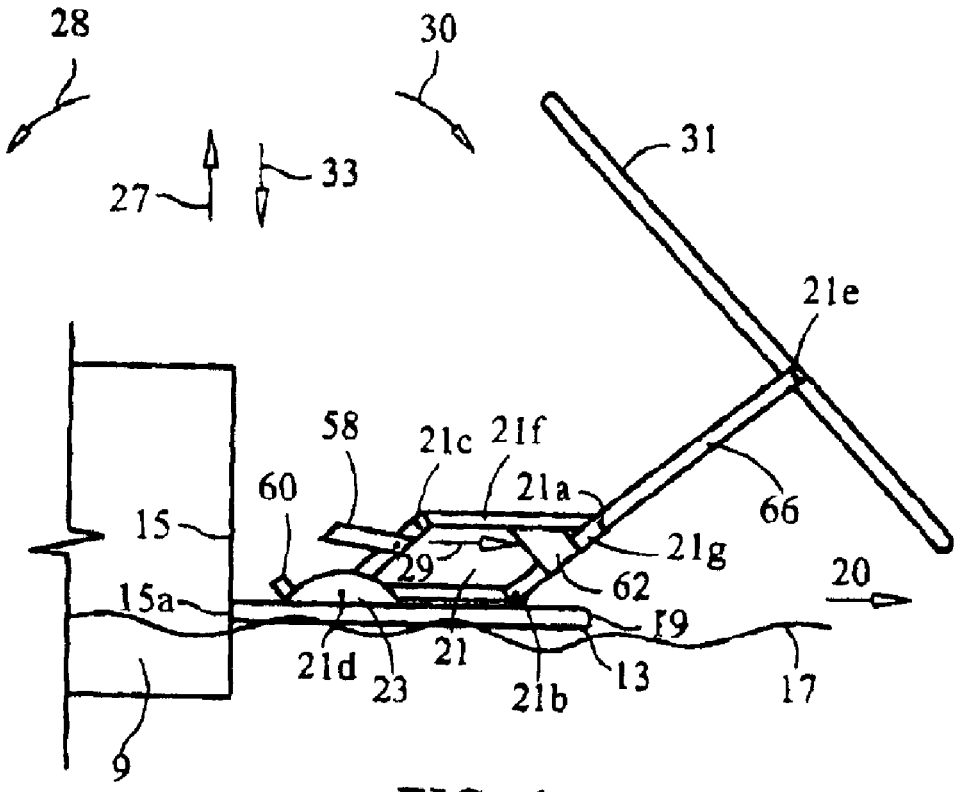
FIG. 6 is FIGS. 3 and 3*a*, modified to show the support platform mounted for pivoting movement on a support frame support leg extension and in its launch retrieval position, with limit stops to prevent the support frame from over traveling its launch retrieval position.

Additionally, other suitable means may be used to stop the travel of the support frame 21 when in its storage carry position, as shown for a preferred embodiment, in FIG. 5. As shown in FIG. 5, the translational movement of support frame 21, is limited to the quadrant on the launch retrieve side of the vertical center 27, as shown in FIG. 1*a*, and where the torque on the support frame 21 from the weight of the support platform 31 is in the direction of arrow 30. In a preferred embodiment, suitable means like auxiliary support 92 cooperating with stop 94 on leg 21*g*, may be used to hold the support frame in position. The support 92 as shown in a preferred embodiment, may be mounted for rotational movement, in or out of operation with support frame 21, by pivot joint 98 in auxiliary support base 96 on base 13. Support frame 21 main axis 29, is shown for purpose of explanation, parallel to but displaced from the center of the support frame 21.

Any suitable means may be used to dock or restrain movement of, the support platform 31 and the support frame 21, at the intended limit of travel from one of its positions to another or at any between location, including electrical or mechanical limit switches and mechanically operated or electrically operated stops, as would be now or in the future, known to those skilled in the art.

FIG. 4, shows the support frame 21 and support platform 31 from the front or forward part of the main vessel looking aft toward the transom 15, at the aft part of the main vessel 9 and with the support frame comprising port parallelogram frame 21*p* and starboard parallelogram support frame 21*s*, arranged in a parallelepiped in the launch retrieve position. A rotating connection shown as a pivot joint or pivot connection 21*a* is shown for explanation purpose, as it would appear in its position aft or behind pivot joint 21*c*, as may be seen in FIG. 2, to show the connection of the support frame to the support platform 31. As may be seen in a preferred embodiment, as shown in FIG. 4, the support box frame parallelepiped 48 is formed by the connector 51, connecting the port support frame and starboard support frame, respectively identified by 21*p* and 21*s* to distinguish their respective locations on the base platform 13. As shown in FIG. 5, the support frames 21*p*, 21*s*, are shown in a front view with reference to the for aft alignment of the main vessel 9 and with reference to FIG. 2, with connectors 51 connecting support frame legs between pivoting connector 21*d* and 21*c* and between 21*a* and 21*b*, and with the connector 51 connecting the support frame legs between pivoting connectors 21*a* and 21*b* shown hidden b The box frame 48, is connected by the support frames 21*s* and 21*p*, to the respective support frame bases 23*s* and 23*p* at base pivot joints 21*d*. The support frame 31 is shown, in the position shown in FIG. 2, and in the launch retrieve position with end 24, not shown behind the base 13, shown in cross section, and opposed to the open water end 19 (not shown), of base 13.

The support frame 31 is shown in FIG. 4, mounted in outside the support frames 21*p* and 21*s*, and as would be known to those skilled in the art, the support frame 31 may be mounted inside or outside the support box frame box, 48, without departing from the disclosed inventive principles. Numerals 55 and 57 show the attached location of the port and starboard support frames 21*p* and 21*s*, to the base 13.

FIG. 5 shows a preferred embodiment of the invention with the support frame 21 and platform 31 in the support carry position. In FIG. 5, the support frame 21 is on the launch retrieve side of the vertical center, as shown in FIG. 1*a*, and the weight 33 of the platform 31 drives the platform and its auxiliary vessel 37 into the engagement device 41.

Separately shown in FIG. 5 is a support frame stop 58 mounted on the leg of the support frame 21 between rotating connections 21*d* and 21*c*. The support frame stop 58, rotates with the rotation of support frame 21 about the axis or the rotating connection 21*d*, to engage with base mounted stop 60 to prevent movement of the platform 31 and the support 21 past the limit of its support carry position. Other suitable stops may be used as would be known to those skilled in the art. The docking means 41 is shown in a preferred embodiment with a single cooperating stop 41*b* to limit movement of the storage platform toward the launch retrieves position in the direction of arrow 30. As would be known to those skilled in the art, other suitable locking or docking devices may be used.

FIG. 6 shows in a preferred embodiment, the support 21 and platform 31 with leg 21*g* of the support 21 extending beyond pivot joint 21, and supporting the platform 31 outside the support frame 21 by means of extension 66 on support frame leg 21*g*. As would be understood by those skilled in the art, the support platform 31 may be placed on a support leg within the support frame and between the support frame joints 21*d*, 21*a*, 21*b*, 21*c*, without departing from the disclosed inventive principles.

FIG. 6 shows the operation of the limit stop 62, shown in a preferred embodiment mounted on frame support leg 21*g* and in contact with frame support leg 21*f*, preventing it movement toward support leg 21*g* and translation of the support frame 21 and the support platform beyond the intended stop launch retrieve stop position. As would be understood by those skilled in the art, the stop 62 may be placed on any of the other support legs and any other suitable stop may be used as would be known to those skilled in the art.

As would be understood by those skilled in the art, the disclosed inventive principles may be varied as is now or hereafter known, without departing from the disclosed invention principles.

The invention claimed is:

1. A system for launching and retrieving an auxiliary vessel in the fore aft direction of a main vessel comprising, a main vessel, including a main vessel hull arranged in a fore aft direction; said main vessel hull including a transom on the aft part of said main vessel hull;

a base attached to said main vessel proximate said transom;

a support frame;

said support frame including a first pivoting connection to said base;

a support platform;

said support frame including a second pivoting connection to said support platform;

said support frame connected to said base by said first pivoting connection for displacement of said support platform in a displacement path in said main vessel fore aft direction, and from a first position for launch or retrieval, displaced outboard from said main vessel hull and outboard of said transom, to a second position for storage or carry of an auxiliary vessel, inboard of said main vessel hull and inboard of said transom.

2. The system of claim 1, wherein, said support platform includes a first end and a second end;

said first end is disposed aft from said second end in said main vessel hull fore aft direction;

said support platform connected to said support frame, by said second pivoting connection for rotation between an inclined position with said first end lower than said second end, for launch or retrieval of an auxiliary vessel to a horizontal position, for storage or carry of an auxiliary vessel.

3. The system of claim 2, wherein, said displacement path includes a center vertical position between said first position and said second position, where the direction of a force from the weight of said support platform is through said first pivoting connection.

4. The system of claim 3, wherein, said first pivoting connection includes a first axis of rotation;

said displacement path includes a position disposed between said center vertical position and first position where said force from the weight of said support platform produces a torque about said first axis of rotation causing a rotation of said support frame toward said first position.

5. The system of claim 4, wherein, said displacement path includes a position disposed between said center vertical position and second position where said force from the weight of said support platform produces a torque about said first axis of rotation causing a rotation of said support frame toward said second position.

6. The system of claim 1, wherein, said displacement path is from inboard said main vessel hull, over said transom, and outboard said main vessel hull.

7. The system of claim 5, wherein, said support frame includes at least a first and second sets of at least four legs, arranged in respective first and second parallelograms;

said respective first and second parallelograms each including said first pivoting connections and said respective first and second parallelograms are each connected to said base by said first pivoting connections; and said respective first and second parallelograms are connected to form a parallelepiped for rotation about said first pivoting connections.

8. The system of claim 7, wherein, said respective first and second parallelograms each include said second pivoting connection and each said respective first and second parallelograms include a major axis with a length extending from said first pivoting connection to said second pivoting connections of said respective parallelograms;

said respective first and second parallelograms are mounted on said base wherein said major axis length contracts as said support frame is rotated in said fore aft path toward said center vertical position and expands as said support frame is rotated away from said center vertical position.

9. The system of claim 8, including, a stop mounted for engagement with said support frame to stop movement of said support frame in said displacement path, past said first position or said second position.

10. The system of claim 9, including, a docking fixture including a first interlocking part on said main vessel and a second interlocking part on said support platform;

said docking fixture placed in said displacement path proximate said second position to engage said second interlocking part when said support platform is in said second position.

11. A system for launching, retrieving an auxiliary vessel and for carrying the auxiliary vessel on board a main vessel comprising, a main vessel means arranged in a fore aft direction and including transom means;

a first means for supporting an auxiliary vessel;

a second means for supporting said first means;

third means for rotationally connecting said second means to said main vessel means;

fourth means for rotationally connecting said first means to said second means;

said second means rotationally connected to said main vessel means by said third means for displacement of said first means in a displacement path in said main vessel means fore aft direction from a first position for launch or retrieval, displaced outboard from said main vessel means and outboard of said transom, to a second position for storage or carry of an auxiliary vessel, inboard of said main vessel means and inboard of said transom.

12. The system of claim 11, wherein, said first means includes first end means and second end means and said first end means is disposed aft from said second end means, in said main vessel means fore aft direction;

said fourth means for rotating movement of said first means to an inclined position with said first end means lower than said second end means, when said first means is in said first position for launch or retrieval of an auxiliary vessel, to a position wherein said first end means is rotated toward a horizontal position for storage or carry of an auxiliary vessel.

13. The system of claim 12, wherein, said first means including means for producing a force; said second means includes means for a center vertical position in said displacement path, between said first position and said second position, wherein said force is aligned with said third means.

14. The system of claim 13, wherein, said displacement path includes a position disposed between said center vertical position and said second position where said means for producing a force produces a torque about said third means for causing rotation of said second means toward said second position in said displacement path or said displacement path includes a position disposed between said center vertical position and said first position where said means for producing a force produces a torque about said third means for causing a rotation of said support frame means toward said first position in said fore aft path.

15. The system of claim 11, wherein, said third means displaces said first means in said displacement path, over said transom means.

16. The system of claim 14, wherein, said second means includes means for at least two parallelograms; said means for at least two parallelograms include respective first and second sets of at least four legs, and means for rotationally connecting said legs;

said third means and said fourth means, each include said means for rotationally connecting respective legs of said first and second parallelograms.

17. The system of claim 16, including, a stop means mounted for engagement proximate said second means to stop movement of said second means in said displacement path, past said first position or a stop means mounted for engagement proximate said second means to stop movement of said second means past said second position.

18. The system of claim 11, including, a docking means including a first interlocking means on said main vessel means and a second interlocking means on said second means;

said docking means including means for placing said docking means in said displacement path proximate said second position to engage said second interlocking means when said first means for supporting an auxiliary vessel is in said second position.

19. The system of claim 16, wherein, said means for at least two parallelograms each include a major axis with a length extending from said third to said fourth means; and wherein, said major axis length contracts as said second means is displaced in said displacement path toward said center vertical position and expands as said support frame is rotated away from said center vertical position.

* * * * *